United States Patent [19]

Mentzer

[11] Patent Number: 4,635,805

[45] Date of Patent: Jan. 13, 1987

[54] CRANE BOOM LOCKING PIN INSERTION INDICATOR AND ACTUATOR MEANS

[75] Inventor: William R. Mentzer, Shady Grove, Pa.

[73] Assignee: Kidde, Inc., Saddle Brook, N.J.

[21] Appl. No.: 318,591

[22] Filed: Nov. 5, 1981

[51] Int. Cl.[4] ..... B66C 23/04; B66C 13/16; B66C 23/06

[52] U.S. Cl. ..... 212/230; 212/157; 212/264; 212/268; 212/269; 52/118; 52/115; 74/110

[58] Field of Search ..... 52/118, 115; 212/183, 212/230–231, 264, 266–269, 157; 74/110

[56] References Cited

U.S. PATENT DOCUMENTS

| | | | |
|---|---|---|---|
| 2,924,107 | 2/1960 | Fiesard et al. | 74/110 |
| 3,346,281 | 10/1967 | Thompson | 52/115 X |
| 3,386,594 | 6/1968 | Grove | 212/268 |
| 3,738,075 | 6/1973 | Hansel | 52/115 |
| 3,842,985 | 10/1974 | Svede | 212/264 |
| 3,921,819 | 11/1975 | Spain | 212/268 |
| 4,053,058 | 10/1977 | Jensen et al. | 212/268 |
| 4,198,909 | 4/1980 | Plantureux | 74/110 |
| 4,327,533 | 4/1982 | Sterner | 52/115 |
| 4,352,434 | 10/1982 | Poock | 212/230 |
| 4,433,515 | 2/1984 | Mentzer | 52/115 |

OTHER PUBLICATIONS

Mechanism, Linkages, and Mechanical Controls by N. P. Chironis; pp. 80–81, "10 Ways to Change Straight--Line Direction", 1965.

*Primary Examiner*—Trygve M. Blix
*Assistant Examiner*—R. B. Johnson
*Attorney, Agent, or Firm*—Brady, O'Boyle & Gates

[57] ABSTRACT

A power actuator on the base section of a multi-section telescoping crane boom can bridge at least one intermediate boom section to operate a biased locking pin retract mechanism employed in a system for remotely controlling the operation of a manual fly section of the telescoping boom. To enable the crane operator to know with certainty that the biased locking pin is in a fully engaged position, a visual indicator on the boom readily viewable from the crane operator's cab is directly mechanically linked to the biased locking pin and moves to the indicating position only when the locking pin is fully engaged.

6 Claims, 5 Drawing Figures

CRANE BOOM LOCKING PIN INSERTION INDICATOR AND ACTUATOR MEANS

CROSS-REFERENCE TO RELATED APPLICATION

This application contains subject matter in common with application Ser. No 318,039, filed Nov. 4, 1981, for REMOTELY OPERABLE LATCH AND LOCKING PIN FOR A MULTI-SECTION BOOM INCLUDING A MANUAL FLY SECTION, and both applications have a common assignee.

BACKGROUND OF THE INVENTION

The demand for cranes of ever-increasing size and lifting capacity has created some rather basic departures from traditional crane boom design standards, particularly for hydraulically operated telescoping booms. For example, U.S. Pat. No. 4,327,533, issued May 4, 1982, discloses an arrangement utilizing a single hydraulically operated extension and retraction cylinder for a five-section massive telescoping boom in cooperation with biased locking pins for the individual boom sections.

U.S. Pat. No. 3,921,817 discloses a latching and pin locking mechanism for the manual fly section of a multi-section telescoping boom requiring manipulations by an attendant at ground level when the boom is in a horizontal position.

The above-referenced patent application discloses a remotely operable latch and locking pin arrangement for the manual fly section of a multi-section telescoping boom, avoiding the necessity for extending hydraulic lines and/or electrical cables forwardly on the boom to the fly section or locations near the fly section.

Consistent with these developments in an overall effort to render the construction and operation of telescoping booms practical and safe in light of the above basic changes, the present invention seeks to provide an automatic safety indicator whereby the crane operator will know with certainty that the biased locking pin or pins for the boom fly section is fully engaged. Toward this end, a movable visual indicator element on the boom easily viewable from the crane operator's cab is mechanically coupled with the biased locking pin for the boom fly section so that whenever this pin becomes fully engaged or active to secure the fly section the indicator element will unfailingly move to the viewing or indicating position. In concert with this feature of the invention, a retract mechanism for the biased locking pin includes a power actuator on the boom base section which has the ability to bridge or reach across at least one intermediate telescoping boom section to cause power retraction of the biased locking pin or pins to an inactive position relative to the boom fly section.

Other features and advantages of the invention will become apparent during the course of the following detailed description.

DETAILED DESCRIPTION

Figure 4:
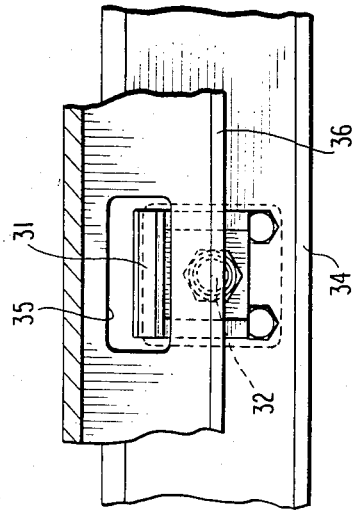
FIG. 4 is a fragmentary vertical section taken on line 4—4 of FIG. 3.
Figure 1:
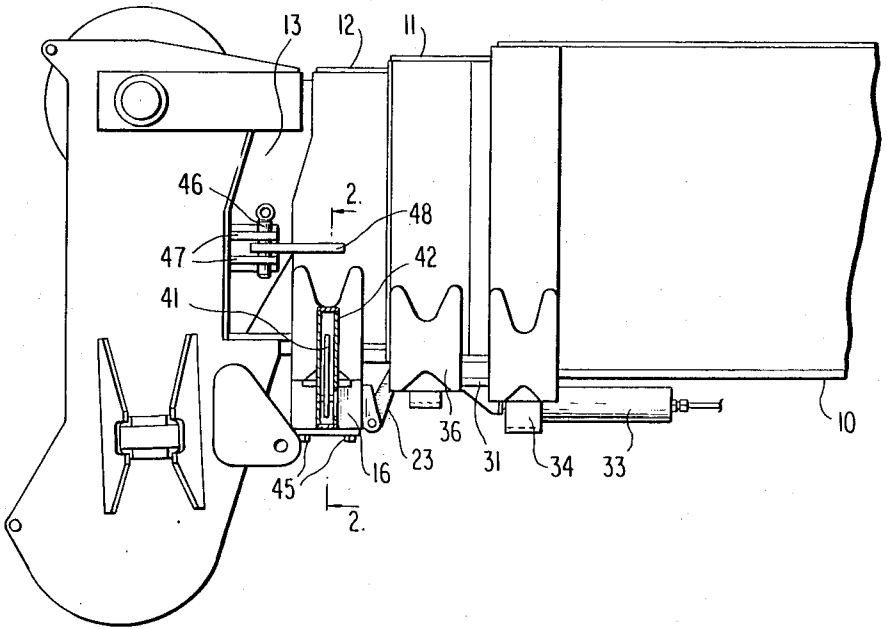
FIG. 1 is a fragmentary side elevation of a multisection boom in accordance with the present invention in a retracted condition.

Referring to the drawings in detail wherein like numerals designate like parts, a multi-section telescoping boom is shown in the drawings which includes a base section 10, inner and outer mid-sections 11 and 12, and a manual fly section 13. While the invention is disclosed for convenience with this particular boom configuration, it should be understood that the invention is equally applicable to telescoping booms having a greater or lesser number of telescoping sections.

Figure 2:
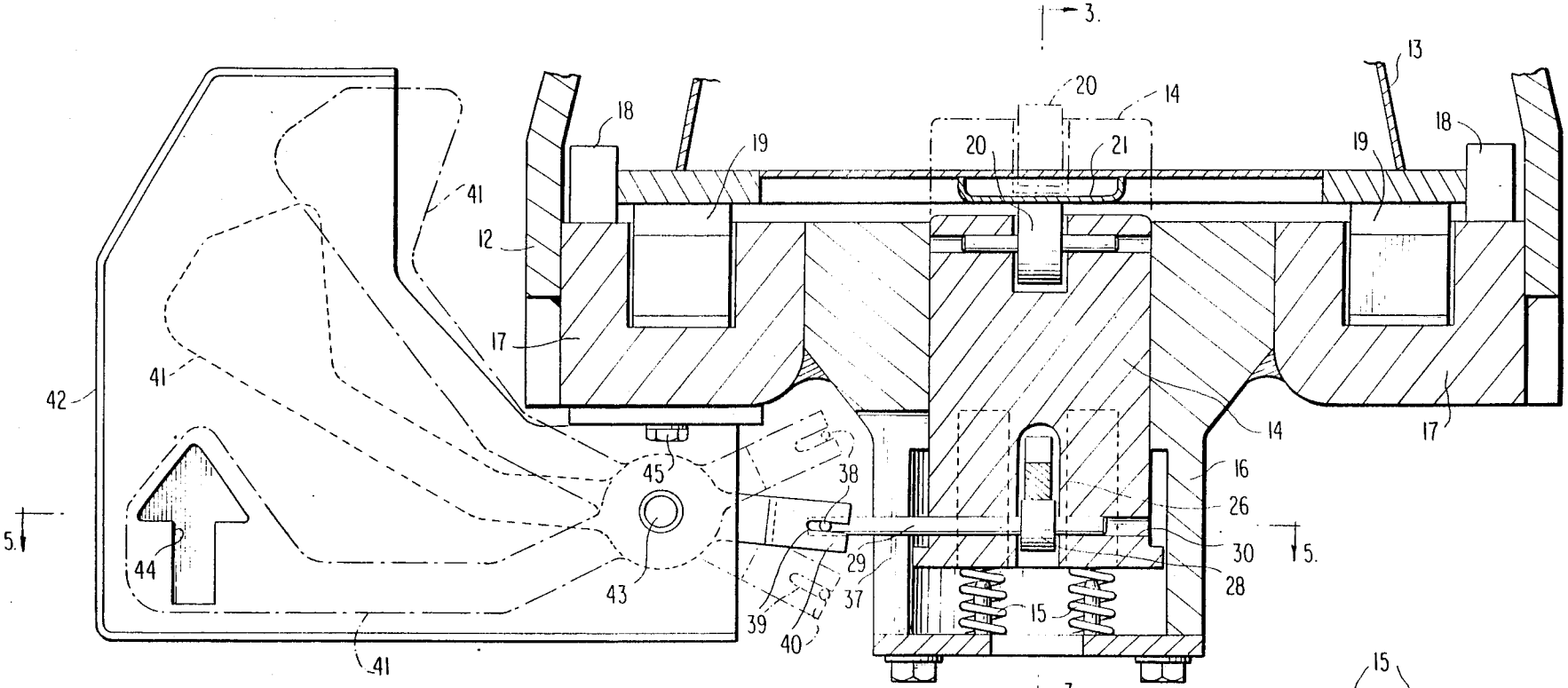
FIG. 2 is an enlarged transverse vertical section taken on line 2—2 of FIG. 1.
Figure 5:
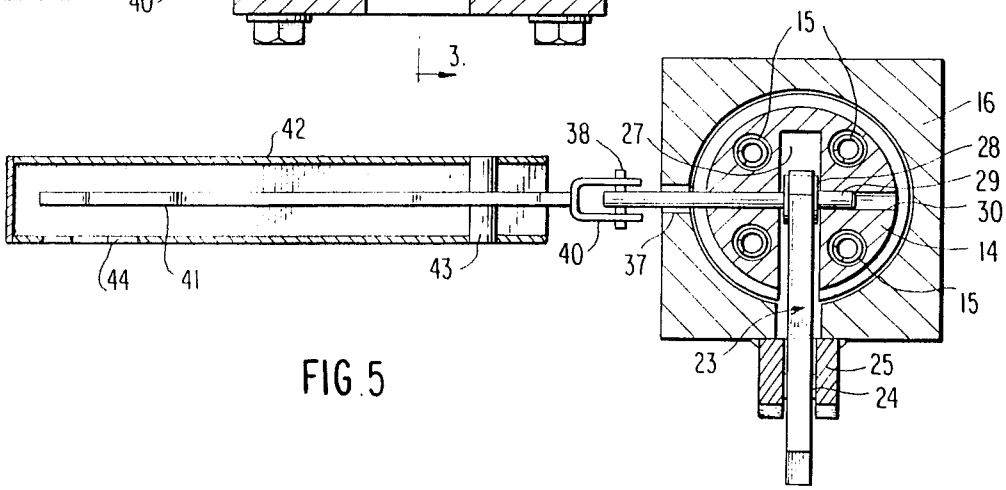
FIG. 5 is a horizontal section on a reduced scale taken on line 5—5 of FIG. 2.

As fully disclosed in the above-referenced application, a locking pin 14 for the manual fly section 13 is biased to an engaging position with the fly section by springs 15 held within a guide housing 16 for the locking pin depending from and forming a part of the underslung wear pad structure for the fly section at the forward end of the forward mid-section 12, FIG. 2. This wear pad structure includes holders 17 for lateral wear pads 18 straddling the manual fly section 13 and bottom wear pads 19 for the manual fly section.

At its top, the biased locking pin 14 carries a guide roller 20 in rolling contact with a precision channel element 21 fixed to the bottom of fly section 13 at the center thereof. Near the rear end of manual fly section 13, a receiver opening 22 for the locking pin 14 is formed through the bottom wall of the fly section so that the latter may be securely locked by the pin 14, as described in the referenced application. It can be seen that the roller 20 of the biased locking pin 14 will roll on the surface of channel element 21 during forward movement of the manual fly section 13 relative to the outer mid-section 12. The biased pin 14 will automatically engage lockingly in the opening 22 of the manual fly section when the relative movement causes the pin to register with the opening 22.

Also as disclosed in the referenced application, a power retract mechanism for the pin 14 is provided including a retract bell crank 23 pivoted at 24 to a fixed bracket extension 25 on the housing 16. One arm 26 of this bell crank enters a chamber 27 of the locking pin 14 and engages above a retract roller 28 held on a shaft 29 received in a transverse bore 30 of the locking pin 14.

The other arm of bell crank 23 exteriorly of the housing 16 is in the path of movement of a rigid projecting retract member 31 or finger secured to the piston rod 32 of a relatively small hydraulic cylinder 33 fixed to the wear pad structure 34 of the boom base section 10 at the forward end of the latter. The cylinder 33 is illustrated as a single acting cylinder with spring return. In some cases, it can be a double acting cylinder as convenience dictates. The drawings illustrate the retract or actuator member 31 in a fully retracted position relative to the bell crank 23 and cylinder 33. An opening 35 provided in the wear pad structure 36 of boom inner mid-section 11 receives the actuator member 31 and allows the latter to bridge or reach forwardly of the boom section 11 in order to operate the bell crank 23 of locking pin 14 which, as described, is on the outer mid-section 12 of the boom. In cases where the telescoping boom may have one or more additional sections, openings may be provided similar to the opening 35 to enable the actuator member 31 to bridge or reach forwardly of two or more boom sections in order to operate the bell crank 23 which is thus mounted on the boom section immediately surrounding fly section 13.

The shaft 29 of roller 28 extends through a slot 37 of housing 16 and outside of the housing carries a cross pin 38 engaging in a slot 39 formed in a clevis 40 attached to the interior end of a visual indicator element or flag 41 disposed in a narrow housing 42 and pivoted between the side walls of this housing by a pivot pin 43. Near its lower outer corner, the housing side wall nearest the crane operator has a viewing opening 44 preferably shaped as an upwardly extending arrow indicative of the fact that the locking pin 14 is fully up or engaged in the opening 22 of manual fly section 13.

At least the adjacent side face of the pivoted indicator flag 41 is painted bright orange or yellow to be easily viewable through the opening 44 when the flag is in the down position shown in FIG. 2 in response to full upward engagement of the locking pin 14 by the action of springs 15 as shown in phantom lines in the drawings. When the biased locking pin 14 moves upwardly, it carries along the shaft 29 which in turn through the cross pin 38 and slotted clevis 40 swings the indicator flag 41 counterclockwise and downwardly on its pivot axis to expose the flag to view through the opening 44, enabling the crane operator to know with certainty that the locking pin is fully engaged. In all other positions, the indicator flag is concealed from view or substantially concealed as shown in FIG. 2.

The interior narrow side of the housing 42 can be entirely open and the housing is profiled to fit close to one side of boom section 12 with its lower end portion disposed under wear pad structure 17 and bolted thereto as at 45. The clevis 40 extends outside of the housing in the open space between it and the locking pin housing 16.

It may now be seen that the invention provides a power retract means for the manual fly section locking pin 14 carried by the outer mid-section 12 of the boom. A power actuator in the form of cylinder 33 on the boom base section can reach ahead of the intervening telescoping section 11 or sections to operate a mechanical retract element for the locking pin 14 on the boom section 12 carrying the locking pin. Additionally, the invention provides a simple visual indicator on the same side of the boom as the operator's cab directly mechanically linked to the biased locking pin 14 so that full engagement of this pin and only full engagement will place the indicator in its viewable position. The mechanism is simplified, very compact and positive in operation.

With the arrangement shown, the locking pin 14 does not lock the fly section 13 or other such section to the outer mid-section 12. Therefore, in the travel condition of the crane, the front of the fly section 13 is locked to the front of the outer mid-section 12 by means of a removable locking pin 46 extending through registered apertures in overlapping plates 47 and 48, respectively, of the fly section 13 and the outer mid-section 12.

It is to be understood that the pin insertion indicator assembly of the invention is adapted for use with locking pins actuated by power means other than that shown, such as by electrical solenoids or individual hydraulic or air operated cylinders on the boom section carrying the pins or on another boom section. The pin insertion indicator assembly can also be used with hand operated locking pins. Additionally, in certain boom configurations, a separate pin insertion indicator housing 42 can be connected on the outer end of two or more boom sections to give the operator a visual indication of which boom sections are positively pinned together.

Figure 3:
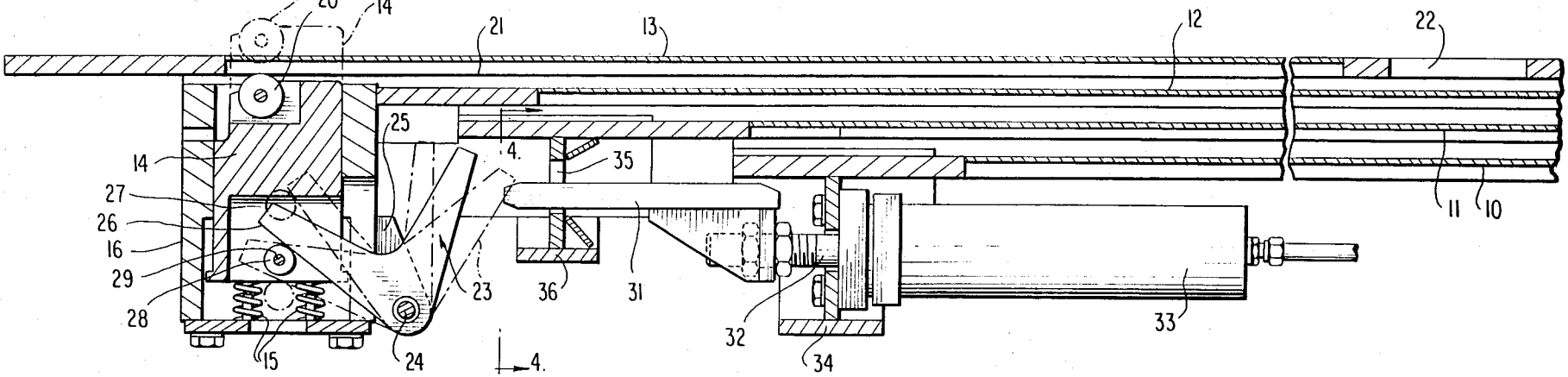
FIG. 3 is a fragmentary vertical section taken on line 3—3 of FIG. 2.

It is also to be understood that two or more cylinders 33 may be arranged side-by-side beneath base section 10 and have actuator members 31 of different lengths to actuate locking pins on respectively different telescoping boom sections. For example, referring to FIG. 3 which shows a four section boom, if a fifth telescoping boom section was inserted inside fly section 13, another locking pin 14 can be arranged in the wear pad housing 17 on the outer end of fly section 13 to lock the fifth section to the fly section when extended from the end of the fly section. An actuator member 31, of greater length than shown in FIG. 3, extends from the cylinder 33 on the base section, through the opening 35 in the wear pad housing 36 of the inner mid-section 11, past or through an opening in housing 16 on the outer mid-section 12, and into contact with a retract bell crank on the front of the fly section to retract the locking pin on the fly section from locking engagement with the fifth section.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a multi-section telescoping boom for cranes or the like having a base section and a manual fly section requiring locking to the boom section immediately surrounding the manual fly section, wear pad structure for the fly section at the forward end of said boom section, a locking pin for the manual fly section on said boom section, a guide housing for the locking pin depending from and forming a part of said wear pad structure, said locking pin being slidably mounted in said housing, the manual fly section having a pin receiver adapted to move into registry with the locking pin at proper times, spring means mounted in said housing for biasing said locking pin outwardly of said housing into said pin receiver, a bell crank lever pivotally mounted on said housing for retracting said biased locking pin from the pin receiver, power actuator means on said base section including a movable actuator adapted to reach forwardly of the base section and forwardly of at least one intermediate telescoping boom section when the boom section is retracted to engage and operate said bell crank lever, said bell crank lever having a first arm operatively engaged with the biased locking pin internally thereof and a second arm extending into the path of movement of said movable actuator member externally of the locking pin, and a through passage provided in said wear pad structure for allowing the movable actuator member to project forwardly of the wear pad structure to reach and operate the bell crank lever.

2. In a multi-section telescoping boom as defined in claim 1, wherein a roller is mounted on the outer end of said locking pin for rolling contact with said fly section.

3. In a multi-section telescoping boom as defined in claim 1, wherein a chamber is provided in said locking pin, a roller rotatably mounted in said chamber, the first arm of said bell crank lever being received in said chamber and engaging said roller.

4. In a multi-section telescoping boom for cranes or the like having at least a base section and an outer section requiring locking to an intermediate boom section immediately surrounding the outer section, and at least one other intermediate telescoping boom section between said base section and said first-mentioned intermediate boom section, wear pad structure for the outer section at the forward end of the first-mentioned intermediate boom section, a locking pin for the outer section on said first-mentioned intermediate boom section, a guide housing for the locking pin depending from and forming a part of said wear pad structure, said locking pin being slidably mounted in said housing, the outer section having a pin receiver adapted to move into registry with the locking pin at proper times, spring means mounted in said housing for biasing said locking pin outwardly of said housing into said pin receiver, a bell crank lever pivotally mounted on said housing for retracting said biased locking pin from the pin receiver, power actuator means on said base section including a movable actuator adapted to reach forwardly of the base section and forwardly of said at least one other intermediate telescoping boom section when the boom is retracted to engage and operate said bell crank lever, said bell crank lever having a first arm operatively engaged with the biased locking pin internally thereof and a second arm extending into the path of movement of said movable actuator member externally of the locking pin, and a through passage provided in said wear pad structure for allowing the movable actuator member to project forwardly of the wear pad structure to reach and operate the bell crank lever.

5. In a multi-section telescoping boom as defined in claim 4, wherein a roller is mounted on the outer end of said locking pin for rolling contact with said outer section.

6. In a multi-section telescoping boom as defined in claim 4, wherein a chamber is provided in said locking pin, a roller rotatably mounted in said chamber, the first arm of said bell crank lever being received in said chamber and engaging said roller.

* * * * *